US005924308A

United States Patent [19]

Rathbone

[11] Patent Number: 5,924,308

[45] Date of Patent: Jul. 20, 1999

[54] HEAT EXCHANGE METHOD AND APPARATUS

[75] Inventor: Thomas Rathbone, Farnham, United Kingdom

[73] Assignee: The BOC Group plc, Windlesham, United Kingdom

[21] Appl. No.: 09/040,235

[22] Filed: Mar. 16, 1998

[30] Foreign Application Priority Data

Mar. 21, 1997 [GB] United Kingdom ..... 9705889

[51] Int. Cl.[6] ..... F25J 1/00

[52] U.S. Cl. ..... 62/643; 62/903

[58] Field of Search ..... 62/643, 902, 903, 62/905; 165/166

[56] References Cited

U.S. PATENT DOCUMENTS

| | | | |
|---|---|---|---|
| 4,599,097 | 7/1986 | Petit et al. | 165/166 |
| 4,606,745 | 8/1986 | Fujita | 62/903 |
| 5,071,458 | 12/1991 | Grenier et al. . | |
| 5,337,569 | 8/1994 | Darredeau . | |
| 5,537,840 | 7/1996 | Srinivasan . | |
| 5,724,834 | 3/1998 | Srinivasan et al. | 62/903 |

FOREIGN PATENT DOCUMENTS 0 501 471 A2 2/1992 European Pat. Off. .

*Primary Examiner*—Ronald Capossela
*Attorney, Agent, or Firm*—David M. Rosenblum; Salvatore P. Pace

[57] ABSTRACT

A heat exchange apparatus, typically for use in association with a double rectification column for the separation of air, has a downflow reboiler with boiling passages. In addition, there is a condenser in a position at a higher elevation than the reboiler. The condenser is fed with liquefied gas to be reboiled from the sump of a lower pressure column forming part of the double rectification column. A first conduit feeds the liquefied gas under gravity to the reboiler. The feeding of the condenser is effected by a vapor lift pump comprising a second conduit and an expansion valve disposed therein. Some of the liquefied gas is vaporized by passage through the expansion valve, and this vapor provides the vapor lifting pumping effect. The vapor is recondensed in the condenser.

7 Claims, 1 Drawing Sheet

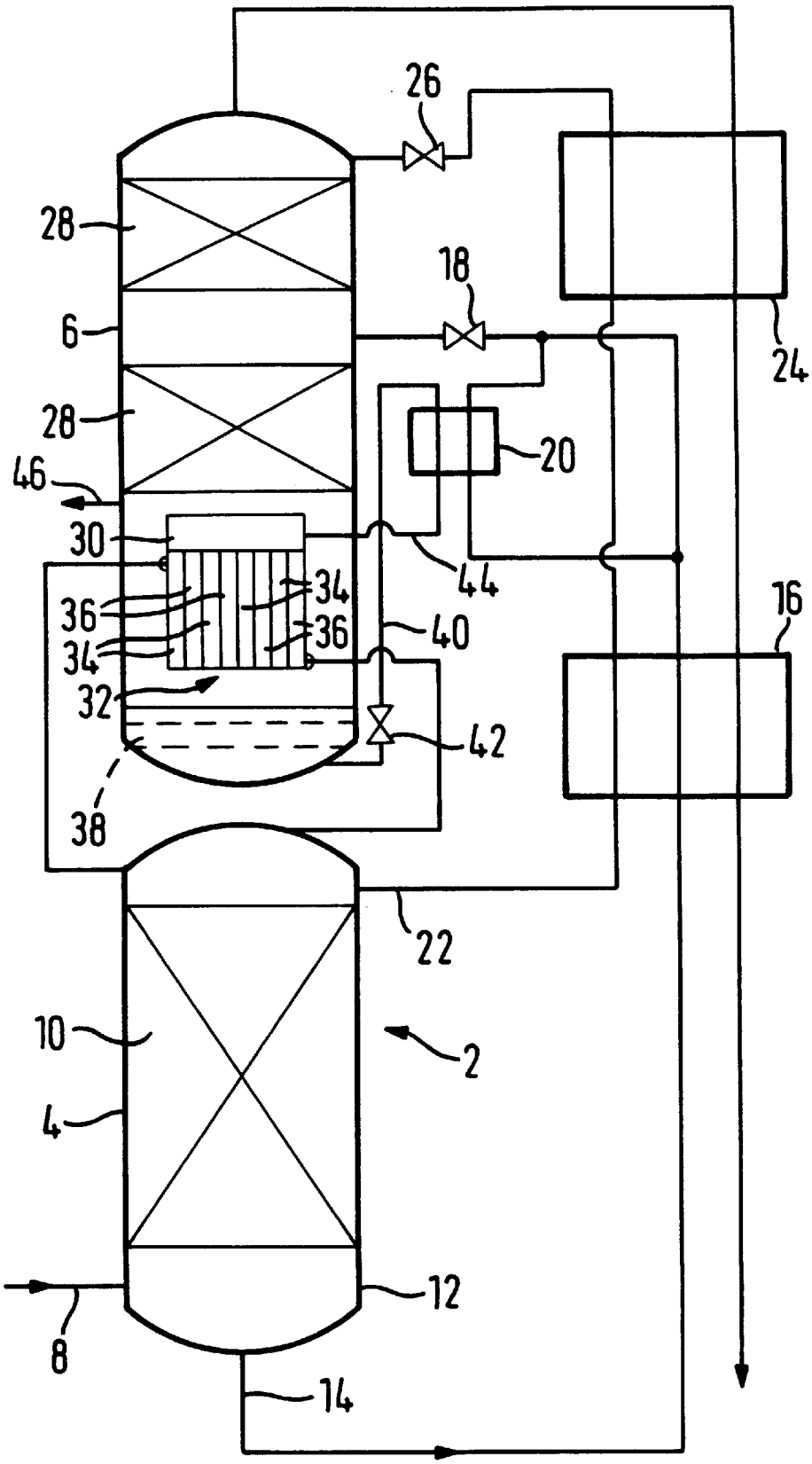
26
28
18
6
24
28
20
46
30
44
34
36
36
40
16
34
32
42
38
22
10
2
4
12
8
14

HEAT EXCHANGE METHOD AND APPARATUS

BACKGROUND

This invention relates to a heat exchange method and apparatus in which a downflow reboiler is employed to boil liquefied gas.

In a conventional cryogenic air separation process the air is rectified in a double rectification column comprising a higher pressure column and a lower pressure column. The two columns are thermally linked by a reboiler-condenser. The reboiling passages of the reboiler-condenser are normally arranged so as to boil liquid oxygen in the sump of the lower pressure column. The necessary heating is provided by nitrogen separated in the higher pressure column. The nitrogen flows through the condensing passages of the reboiler-condenser and is thereby condensed.

The reboiler-condenser is typically at least partially immersed in liquid oxygen in the sump of the lower pressure column. A thermosiphon effect causes passage of the liquid oxygen through the reboiling passages of the reboiler-condenser. Because of the effect of the head of liquid oxygen in the sump there is not an uniform temperature difference from top to bottom of the reboiler-condenser between the boiling liquid and the condensing nitrogen vapor. Accordingly, the average temperature difference is significantly greater than the minimum temperature difference, and the average temperature at which the oxygen boils is similarly greater than it would be at the minimum temperature difference. In consequence, there is an increased consumption of power by the process.

In order to overcome this problem, increasing use is being made of downflow reboilers in which the liquid oxygen to be boiled is fed to the top of the reboiler-condenser and flows downwardly through the boiling passages under gravity. The effect of the head of liquid oxygen in the sump of the lower pressure column is thereby eliminated. One known form of downflow reboiler is disclosed in U.S. Pat. No. 4,599,097.

Typically, the top of the downflow reboiler is located above the volume of liquid oxygen which is held in the sump of the lower pressure column. There is therefore a need to transfer liquid oxygen to be boiled from the sump to the top of the downflow reboiler. A conventional mechanical pump driven by an electric motor can be used for this purpose. Such a pump adds to the cost and complexity of the air separation plant. It has been proposed in AU-A-59857/90 to avoid having to provide such a motor-driven pump by employing a vapor lift pump instead. In a vapor lift pump the effective density of the liquid being transferred is reduced by vaporizing a part of the liquid. If sufficient of the liquid is vaporized the head of liquid in the sump of the low pressure column is sufficient to transfer the liquid from the sump to the top of the downflow reboiler. In AU-A-59857/90 there is disclosed using an auxiliary heat exchanger in order to heat the liquid oxygen being transferred and thereby vaporize some of it. A disadvantage of this arrangement is that there may not be sufficient heat conveniently available to drive the circulation.

It is an aim of the present invention to provide a heat exchange apparatus and method which avoids the use of a motor driven pump to transfer liquid from a sump to a downflow reboiler while at the same time avoiding the need to provide a suitable heating medium.

SUMMARY OF THE INVENTION

According to the present invention there is provided heat exchange apparatus comprising a downflow reboiler for partially boiling liquefied gas and discharging unboiled liquefied gas into a sump, a vapor lift pump for raising a flow of the liquefied gas from the sump to a condenser for condensing vapor in the flow of liquefied gas, the condenser being in a position at a higher elevation than the reboiler, and a first conduit for passing the flow of liquefied gas under gravity from the condenser to the reboiler, wherein the vapor lift pump comprises a second conduit having an expansion valve disposed therein for forming the said vapor.

The invention also provides a heat exchange method including passing to a downflow reboiler liquefied gas from a sump which receives residual unboiled liquefied gas from the downflow reboiler, wherein the passage of the liquefied gas is performed by vapor lift pumping a flow of liquefied gas from the sump to a condenser at a higher elevation than the downflow reboiler, condensing the vapor in the condenser, and feeding the liquefied gas under gravity from the condenser to the downflow reboiler, wherein the vapor is formed by flashing the flow of liquefied gas through an expansion valve upstream of the condenser.

Operation of the condenser ensures that circulation of the liquefied gas is able to be maintained without a heating fluid.

The heat exchange method and apparatus according to the invention are particularly suited for use in association with a double rectification column for separating air. In such an arrangement lower pressure column provides the sump, the liquefied gas comprises a liquid oxygen fraction separated in the lower pressure column, and the downflow reboiler has condensing passages each communicating at an inlet and an outlet with the higher pressure rectification column, whereby nitrogen vapor separated in the higher pressure rectification column is condensed and returned to the higher pressure rectification column.

If desired, the downflow reboiler may be located within the lower pressure rectification column above the sump. Alternatively, it may be located externally of the lower pressure rectification column.

The condenser may be located within the lower pressure column or externally of it. The condenser may be cooled by a flow of oxygen-enriched liquid from the higher pressure column. Accordingly, the condenser may have passages for the flow of the oxygen-enriched liquid which have an inlet communicating with the sump of the higher pressure column. Preferably, the oxygen-enriched liquid is sub-cooled upstream of the passages for the cooling fluid. In an alternative arrangement, the cooling fluid is taken from an intermediate region of the lower pressure rectification column. In such an arrangement, the condenser may be located within the lower pressure column.

The heat exchange method and apparatus according to the invention will now be described by way of example with reference to the accompanying drawing which is a schematic flow diagram, not to scale, of a double rectification column for the separation of air which is associated with heat exchange apparatus according to the invention.

DETAILED DESCRIPTION OF THE INVENTION

Referring to the drawing, there is shown a double rectification column 2 comprising a higher pressure column 4 and a lower pressure column 6. A stream of air flows continuously into the higher pressure column 4 through an inlet 8. The air has been purified by removal of relatively high boiling point impurities. In addition, the air has been cooled to its dew point temperature or to a temperature slightly thereabove. The air typically enters the higher pressure column 4 at a pressure in the range of 3.5 to 5.5 bar. Methods of forming purified air streams at such temperatures and pressures are well known to those skilled in the art.

The air is separated in the column 4 into a nitrogen vapor fraction and an oxygen-enriched liquid fraction. The column 4 is provided with trays or packing or other liquid-vapor contact means 10 in order to effect this separation. A volume of the oxygen-enriched liquid fraction collects in sump 12 of the column 4. A stream of the oxygen-enriched liquid flows from the sump 12 of the column 4 through an outlet 14 and is sub-cooled in a heat exchanger 16. The sub-cooled oxygen-enriched liquid is withdrawn from the heat exchanger 16 and is divided into major and minor flows. The major flow, constituting more than 90% of the sub-cooled oxygen-enriched liquid flow, passes through an expansion valve 18 and is introduced into the lower pressure column 6 at an intermediate level thereof. The minor flow flows through a heat exchanger 20 and provides cooling for that heat exchanger. Downstream of its passage through the heat exchanger 20, a minor flow of oxygen-enriched liquid is united with the major flow at a position upstream of the expansion valve 18. (As will be described below the heat exchanger 20 also functions as a condenser).

A stream of liquid nitrogen is continuously withdrawn from the higher pressure column 4 through an outlet 22 thereof. The flow of nitrogen is sub-cooled by passage through the heat exchanger 16 and another heat exchanger 24. The sub-cooled liquid nitrogen passes through expansion valve 26 and is introduced into the top of the lower pressure column 6. The liquid nitrogen thus provides reflux for the lower pressure column 6.

The oxygen-enriched liquid introduced into the lower pressure column 6 is separated therein into oxygen and nitrogen fractions. If desired, each fraction can be essentially pure, that is it contains less than 1% by volume of impurities, or may be impure. The lower pressure column 6 contains liquid-vapor contact means such as distillation trays or structured packing elements in order to enable the necessary separation to take place. The liquid oxygen fraction is directed through means not shown from the bottom of the liquid-vapor contact means 28 in the column 6 into a header 30 forming part of a downflow reboiler 32. The downflow reboiler 32 comprises an arrangement of reboiling passages 34 in heat exchange relationship with condensing passages 36. As shown in the drawing, the reboiling passages 34 are arranged alternately with the condensing passages 36, although other configurations are possible. As the liquid oxygen fraction flows through the boiling passages 34 so it is partially boiled. A two-phase mixture of liquid and vapor thus issues from the bottom of the boiling passages 34. (It is desirable to avoid boiling the liquid oxygen fraction to dryness in the boiling passages 34 so as not to create a safety hazard.)

Heating for the reboiling passages 34 or the downflow reboiler 32 is provided by continuously passing nitrogen from the top of the higher pressure column 4 through the condensing passages 36 of the reboiler 32. As a result of its heat exchange with the boiling liquid oxygen fraction, this flow of nitrogen is condensed. The resulting condensate is returned to the higher pressure column 4. A part of the condensate is used as liquid nitrogen reflux in the column 4. The remainder forms the liquid nitrogen that is withdrawn from the column 4 through the outlet 24.

The residual, unboiled, liquid fraction issuing from the bottom of the boiling passages 34 of the downflow reboiler 32 collects in sump 38 of the lower pressure column 6. In order to prevent continuous build-up of liquid oxygen in the sump 38 it is necessary to recirculate a part of it to the header 30 of the downflow reboiler 32. Accordingly, there is a conduit 40 placing the sump 38 in communication with condensing passages in the heat exchanger 20. An expansion valve 42 is located in the conduit 40. The expansion valve 42 is positioned such that it is at an elevation below that of the surface of the liquid oxygen in the sump 38. The lower pressure column 6 is typically operated at pressure in the order of 1.3 to 1.4 bar at the bottom of the liquid-vapor contact means. Passage of the flow of liquid oxygen through the expansion valve 42 causes its pressure to be reduced to atmospheric pressure. There is therefore some flashing of the liquid oxygen as it flows through the valve 42 with the result that some vapor is formed. This vapor sufficiently reduces the effective density of the fluid in the region of the conduit 40 downstream of the valve 42 that a vapor lift pumping action is created which is effective to cause the liquid oxygen to flow continuously into the condensing passages of the heat exchanger 20. (The conduit 40 and the valve 42 thus constitute a vapor lift pump.) In these passages, the vaporous part of the oxygen is recondensed by indirect heat exchange with the minor fraction of the sub-cooled oxygen-enriched liquid. The resulting liquid oxygen fraction, now restored to being 100% liquid, flows under gravity from the heat exchanger 20 via another conduit 44 to the distributor 30 of the downflow reboiler 32. The heat exchanger 20 is thus located at a higher elevation than the downflow reboiler 32.

The lower pressure column 6 is provided with an outlet 46 for a gaseous oxygen product. (If desired, a liquid oxygen product may alternatively or additionally be taken.) A nitrogen product is withdrawn from the top of the lower pressure column 6 through an outlet 48. It passes through the heat exchangers 24 and 16 thereby effecting the sub-cooling of the oxygen-enriched liquid and the liquid nitrogen.

I claim:

1. A heat exchange apparatus comprising:

a downflow reboiler for partially boiling liquefied gas and discharging unboiled liquefied gas into a sump;

a vapor lift pump for raising a flow of the liquefied gas from the sump to a condenser condensing vapor in the flow of liquefied gas, the condenser being in a position at a higher elevation than the reboiler; and a first conduit for passing the flow of liquefied gas under gravity from the condenser to the reboiler;

the vapor lift pump comprising a second conduit having an expansion valve disposed therein for forming the said vapor.

2. The heat exchange apparatus according to claim 1, wherein the heat exchange apparatus is associated with a double rectification column for separating air comprising a higher pressure column and a lower pressure column, the lower pressure column providing the sump, and the downflow reboiler having condensing passages each communicating at an inlet and an outlet end with the higher pressure column.

3. The heat exchange apparatus according to claim 2, wherein the downflow reboiler is located within the lower pressure column above the sump.

4. The heat exchange apparatus according to claim 2, wherein the condenser has passages for the flow of oxygen-enriched liquid which have an inlet communicating with the sump of the higher pressure column and an outlet communicating with an intermediate region of the lower pressure column.

5. A heat exchange method including:

passing to a downflow reboiler liquefied gas from a sump which receives residual unboiled liquefied gas from the downflow reboiler;

the passage of the liquefied gas being performed by vapor lift pumping a flow of liquefied gas from the sump to a condenser at a higher elevation than the downflow reboiler;

condensing the vapor in the condenser; and feeding the liquefied gas under gravity from the condenser to the downflow reboiler;

the vapor being formed by flashing the flow of liquefied gas through an expansion valve upstream of the condenser.

6. The heat exchange method according to claim 5, wherein the liquefied gas is liquid oxygen which is separated from air in a double rectification column comprising a lower pressure and a higher pressure column, the lower pressure column providing the sump, and the downflow reboiler having condensing passages which condense nitrogen separated in the higher pressure column.

7. The heat exchange method according to claim 6, wherein the condenser is cooled by oxygen-enriched liquid taken from the higher pressure column or liquid taken from the lower pressure column.

* * * * *